US006776662B2

(12) United States Patent
Self et al.

(10) Patent No.: US 6,776,662 B2
(45) Date of Patent: Aug. 17, 2004

(54) DISCRETE CONNECTOR TERMINATION ADAPTER

(75) Inventors: Bob J. Self, Colorado Springs, CO (US); Robert H. Wardwell, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/256,405

(22) Filed: Sep. 27, 2002

(65) Prior Publication Data

US 2004/0063356 A1 Apr. 1, 2004

(51) Int. Cl.[7] ..... H01R 33/945

(52) U.S. Cl. ..... 439/620; 324/755; 324/754; 324/761; 324/765; 324/158.1; 339/105; 339/176 MA; 339/205

(58) Field of Search ..... 439/620, 69; 324/755, 324/754, 761, 765, 158.1; 339/105, 176 MA, 205

(56) References Cited

U.S. PATENT DOCUMENTS 4,326,765 A * 4/1982 Brancaleone ..... 439/69
5,161,131 A * 11/1992 Borchardt et al. ..... 369/1
5,205,741 A * 4/1993 Steen et al. ..... 439/70
5,479,105 A * 12/1995 Kim et al. ..... 324/755
5,562,499 A * 10/1996 Minich ..... 439/620
6,018,229 A * 1/2000 Mitchell et al. ..... 320/112
6,144,547 A * 11/2000 Retseptor ..... 361/303

* cited by examiner

*Primary Examiner*—Dean A. Reichard
*Assistant Examiner*—Anton B Harris

(57) ABSTRACT

An adapter for attaching a connector having a plurality of pads for interfacing with a device under test. The adapter comprises a carrier having a plurality of voids formed therein in a pattern matching connections on the connector, said voids traversing from a first surface to a second surface of the carrier. At least one electrical component is embedded in at least one void, the at least one electrical component forms a first adapter pad on the first surface of the carrier and a second adapter pad on the second surface of the carrier. When the adapter is interposed between the connector and the device under test the electrical component becomes part of the circuit of the device under test and the connector.

13 Claims, 6 Drawing Sheets

DISCRETE CONNECTOR TERMINATION ADAPTER

BACKGROUND OF THE INVENTION

Designers of test and measurement devices face a variety of challenges in creating cables and connectors that form probes for interfacing with a device under test (DUT). It is known to integrate components, such as R, RC, and RCR networks into the cable (just prior to the connector) to perform such functions as compensation, termination and pin redirection. Such integrated components, referred to herein as networks, should be non-intrusive on the measurement process and in the case of compensation networks should render the entire probe non-intrusive. It is quite difficult to integrate these networks in a completely non-intrusive manner and most known probes have some stub (or non-compensated) length. Further, many of the more successful designs have a mechanically intrusive shape which interferers with the testing procedure.

In particular known cables with networks typically have stiff cable ends, due to the inclusion of a circuit board upon which the networks are mounted. Such configurations limit the usability of the probe. Further, as the network is positioned in the cable path a sizable stub exists comprising the cable connector and the target connector.

In an ideal world, manufactures would include networks on the device under test. However, this is an unrealistic condition for test and measurement designers to impose upon their customers. Not only is the design generally outside the expertise of most customers, it adds cost to the device, something no supplier desires. Another solution is to require the connector manufacturers to design networks into the connector itself. For many of the same reasons, this is unlikely to happen.

The Inventors of the present invention have determined a need for networks that can be easily integrated with standard connectors minimizing stub length while maximizing usability of the probe.

BRIEF DESCRIPTION OF THE DRAWINGS

An understanding of the present invention can be gained from the following detailed description of the invention, taken in conjunction with the accompanying drawings of which.

DETAILED DESCRIPTION

Figure 1:
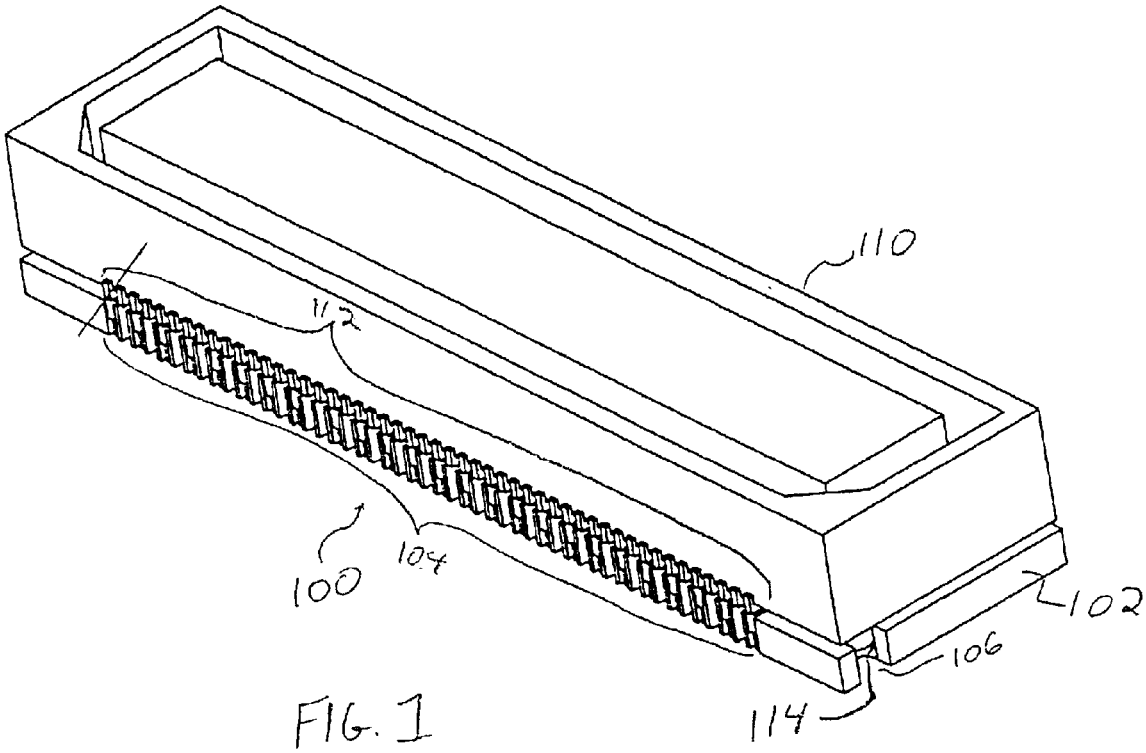
FIG. 1 is an orthogonal view of a connector adapter attached to a connector in accordance with a preferred embodiment of the present invention.

Reference will now be made in detail to the present invention, examples of which are illustrated in the accompanying drawings, wherein like reference numerals refer to like elements throughout.

FIG. 1 is an orthogonal view of a connector adapter 100 ("adapter 100") attached to a connector 110 in accordance with a preferred embodiment of the present invention. It will be appreciated by those of ordinary skill in the relevant arts that the adapter 100, as illustrated in FIG. 1, is generally representative of such adapters and that any particular adapter may differ significantly from that shown in FIG. 1, particularly in the details of construction. As such, the adapter 100 is to be regarded as illustrative and exemplary and not limiting as regards the invention described herein or the claims attached hereto.

The connector 110, as illustrated, typifies a SAMTEC ASP-65067-01 connector. This specific connector is utilized by test and measurement devices marketed by AGILENT TECHNOLOGIES, INC., assignee of the present application. Those of ordinary skill in the art will recognize that many other connectors exist and that the present invention can be suitably modified to interface with most such connectors. The connector 110 provides a series of pads 112 adapted to interface with pads on a device under test. The adapter 100 is soldered to the connector 110 and, as such, is interposed between the connector 110 and the device under test. Generally, the adapter 100 comprises a carrier 102 upon which components are mounted to form networks, for example compensation or termination networks.

To preserve the functionality of the connector 110, the adapter 100 replicates the pads 112 while interposing a network. In general, this is accomplished by machining a series of slots or holes 104 on the edge of carrier 102 and loading the slots with components, such as resistors, capacitors, inductors, and conductive bars (described herein below). The series of slots or holes 104 are aligned with the connections 112 on the connector 110 by at least one post 114 on the connector 110 and at least one slot 106 on the adapter 100. Such alignment effectively interposes the components between the connector 110 and the device under test (not shown). Such an arrangement practically eliminates the stub length with minimal impact on the usability of the probe as a whole.

Figure 2:
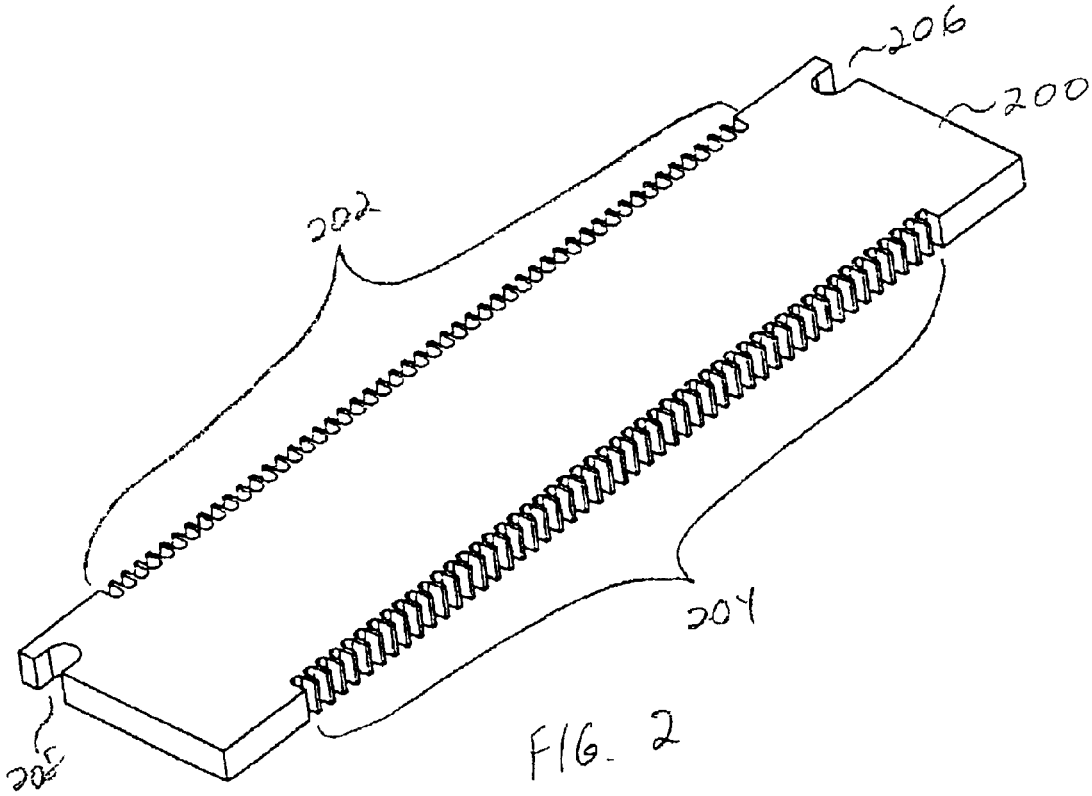
FIG. 2 is an orthogonal view of a carrier in accordance with a preferred embodiment of the present invention.

FIG. 2 is an orthogonal view of a carrier 200 of a connection adapter 100 in accordance with a preferred embodiment of the present invention. The carrier 200 is provided with two series of slots 202 and 204 on opposing edges. Two alignment slots 206 and 208 are provided to mate with alignment pins on a connector. In this case, the alignment slots 206 and 208 and series of slots 202 and 204 are arranged to mate with pins on a SAMTEC ASP-65067-01 connector. In accordance with a preferred embodiment of the present invention, the carrier 200 is preferably 0.040 inches thick, 0.295 inches wide, and 1.231 inches long. Those of ordinary skill in the art will recognize that these dimensions are only suggested dimensions suitable for use with an adapter designed to mate with a SAMTEC ASP-65067-01 connector.

Figure 3:
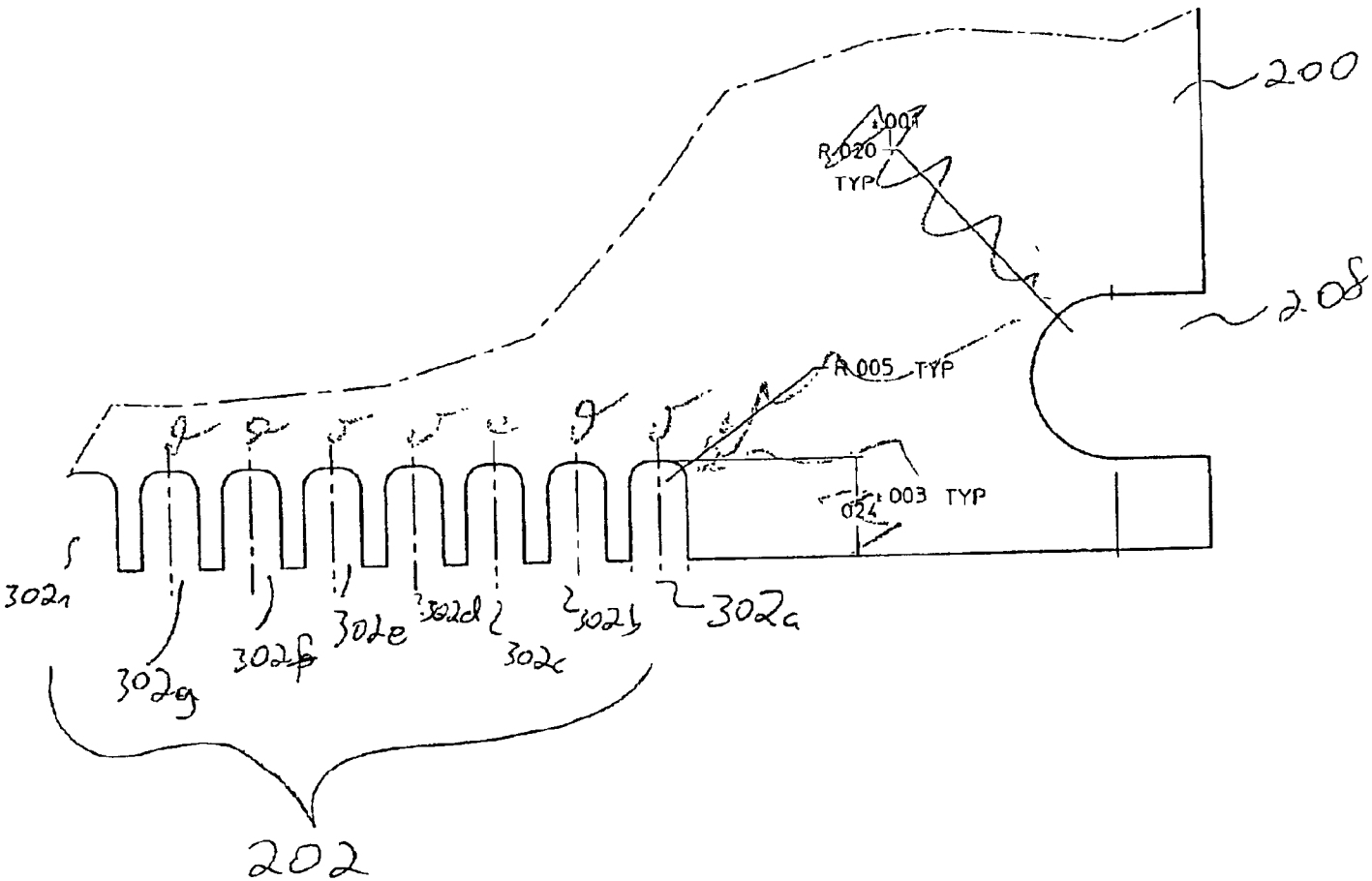
FIG. 3 is an enlarged partial view of the carrier shown in FIG. 2.

FIG. 3 is an enlarged partial view of the carrier 200 shown in FIG. 2. In particular FIG. 3 shows details of slots 302*a* though 302*n* in the series of slots 202. As used herein the letters appended to reference numerals are representative of a specific instance of a structure associated with the element number, with a "n" used to refer to a generic instance of the element or the series of elements as a whole. Preferably the slots 302*n* have a pitch (center to center) of 0.0197. Each slot 302*n* preferably has a width of 0.014 and extends into the carrier 200 to a depth of 0.024. In accordance with the dimensions of the SAMTEC ASP-65067-01 connector, the centerline of the slot 302*a* is 0.133 from the edge of the carrier 200, while the centerline of the alignment slot 208 is 0.042 from the edge of the carrier 200.

Figure 4B:
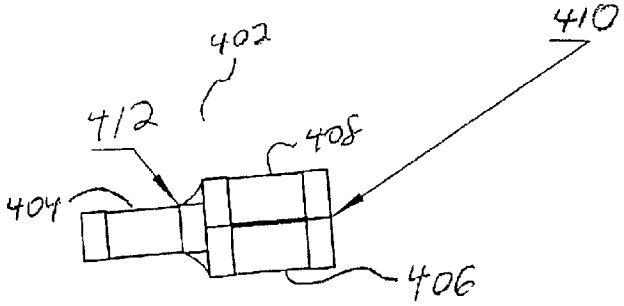
FIG. 4*b* is an illustration of a network component in accordance with a preferred embodiment of the present invention.
Figure 4C:
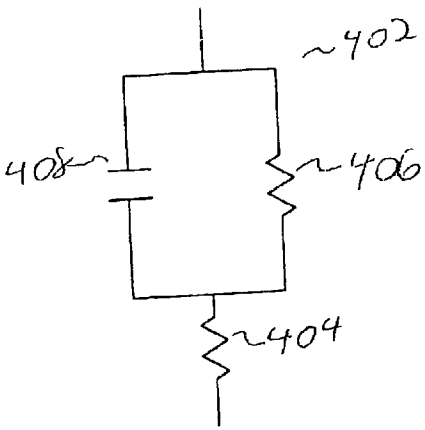
FIG. 4*c* is a circuit diagram of the component shown in FIG. 4*b*.
Figure 4A:
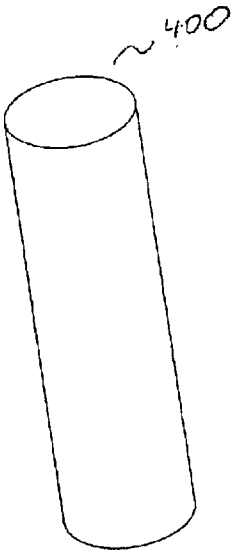
FIG. 4*a* is an orthogonal view of a network component in accordance with a preferred embodiment of the present invention.

FIG. 4*a* is an orthogonal view of a component 400 in accordance with a preferred embodiment of the present invention. In this instance the component 400 is a conductive bar 400 to be inserted into any slot 302*n* (see FIG. 3) for which a shorted connection is desired. Based on the sample dimensions provided above, each conductive bar 400 preferably has a length of 0.049 (slightly thicker than the carrier 200 to form pads that mate with the connector 100 and the device under test) and a diameter of 0.013. Each conductive bar 400 will be simply glued or soldered into place in the slots 302*n* in the carrier 200.

FIG. 4*b* is an illustration of a component 402 in accordance with a preferred embodiment of the present invention. Component 402 is generally representative of a network of discrete circuit elements such as resistors, capacitors and inductors. In this case, the component 402 is an RCR network 402. The RCR network 402 is particularly useful for the formation of compensation and termination networks, the design of which is outside the scope of the present invention. In general, the component 402 is formed of 0201 size discrete resistors and capacitors (and inductors if desired). The component 402 is glued into select slots 302*n*. The entire assembly preferably has a height of 0.049 to create the necessary pads on either side of the carrier 102.

FIG. 4*c* is a circuit diagram of the component 402 shown in FIG. 4*b*. In the example shown in FIG. 4*b*, a resistor 404 is soldered to another resistor 406 and a capacitor 408. More specifically the resistor 406 is soldered, at joint 410, to the capacitor 408 with the resistor 404 being soldered, at joint 412, to both the resistor 406 and the capacitor 410.

Figure 5:
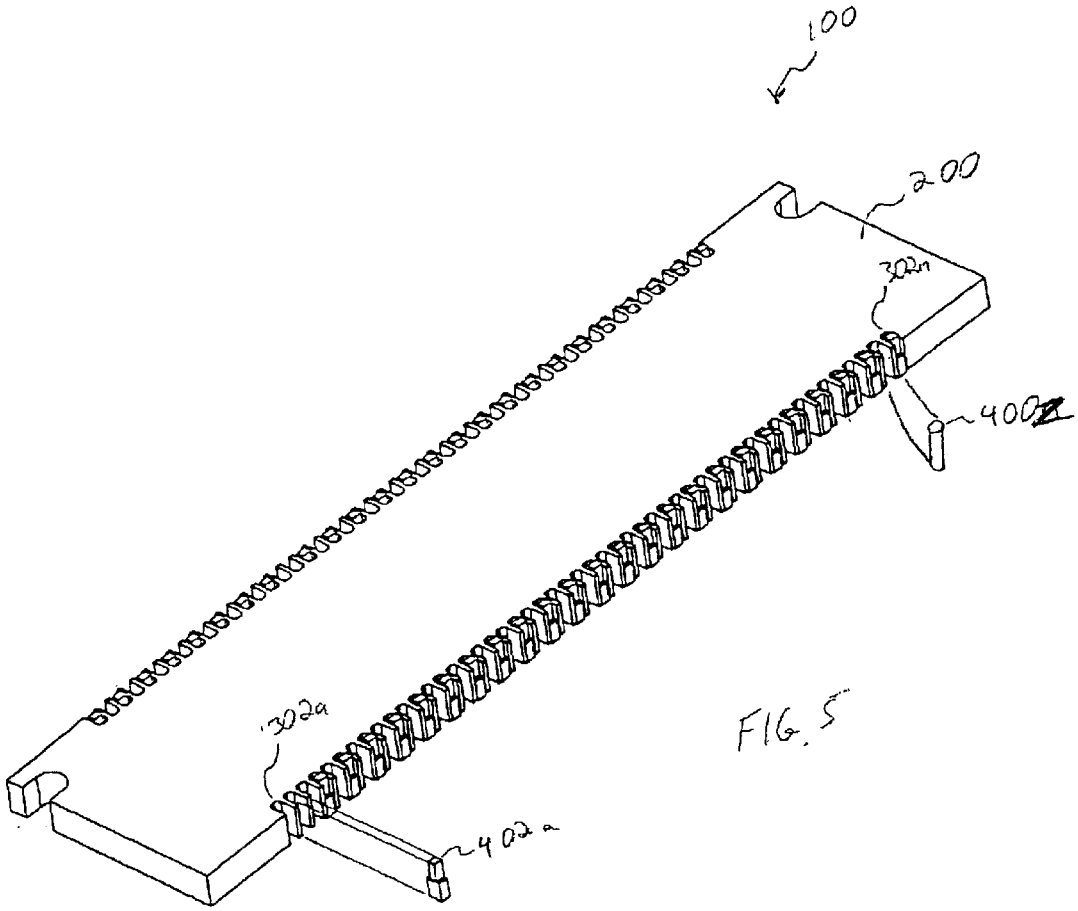
FIG. 5 is an orthogonal view of a connector adapter in accordance with a preferred embodiment of the present invention.

FIG. 5 is an orthogonal view of a connector adapter 100 in accordance with a preferred embodiment of the present invention. FIG. 5 shows a component 402*a* (an RCR) being inserted into a slot 302*a* of the carrier 200 and a component 400*z* (a conductive bar) being inserted into slot 302*z*. The selection of which slots receive RCRs and which slots receive conductive bars is beyond the scope of this disclosure, but will be understood by those of ordinary skill in the art.

Figure 6:
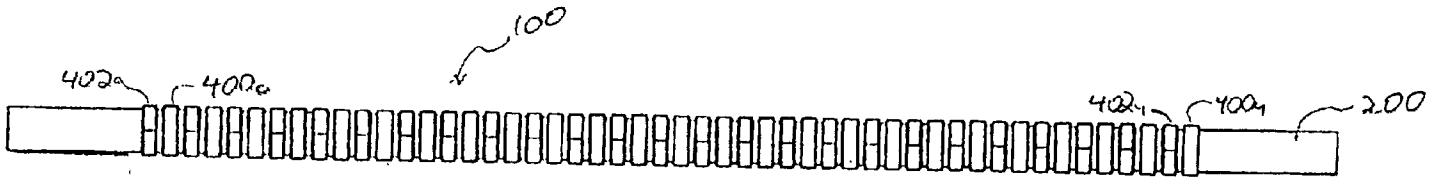
FIG. 6 is a side view of a connector adapter in accordance with a preferred embodiment of the present invention.

FIG. 6 is a side view of a connector adapter 100 in accordance with a preferred embodiment of the present invention. As clearly shown in FIG. 6, the components 402*n* (only 402*a* being labeled for clarity) and 400*n* (only 400*a* being labeled for clarity) protrude from the surface of the carrier 200 to form conductive pads adapted to interconnect a connector and a device under test.

Figure 7:
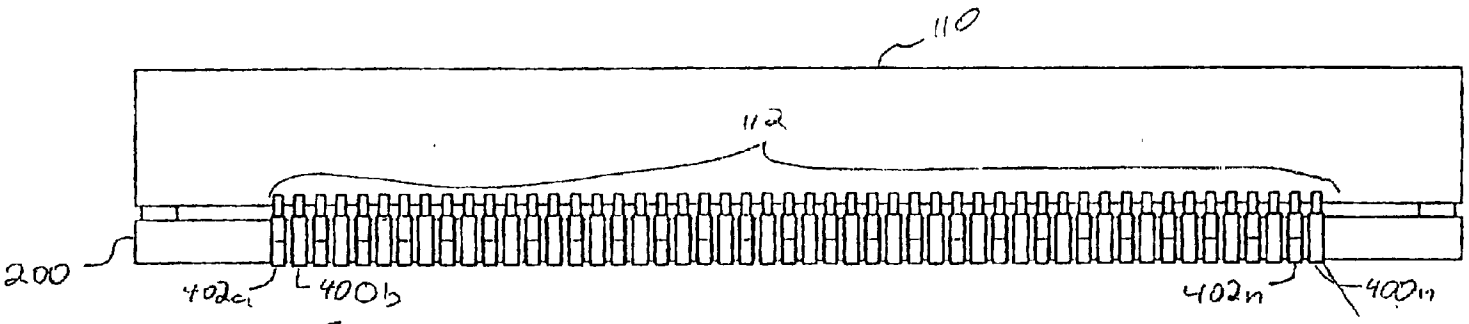
FIG. 7 is a side view of a connector adapter attached to a connector in accordance with a preferred embodiment of the present invention.

FIG. 7 is a side view of a connector adapter 100 attached to a connector in accordance with a preferred embodiment of the present invention. The series of components 400 (only 400*a* being labeled for clarity) and 402 (only 402*a* being labeled for clarity) mate with the series of pads 112 on the connector 110. The pads 112 are, in effect recreated on the surface of the adapter 100 opposite the connector 110. Given that the preferred thickness of the adapter 100 is 0.049, the connecter 110 is raised only slightly from its normal position. Further, due to the embedding of selective component networks, designers may freely program the adapter for different functions and situations. If the adapter 100 is programmed for compensation, the overall probe will have an extremely short stub length small sacrificing only a small amount of height.

Although one embodiment of the present invention has been shown and described, it will be appreciated by those skilled in the art that changes may be made in these embodiments without departing from the principles and spirit of the invention, the scope of which is defined in the claims and their equivalents.

What is claimed is:

1. An adapter for attaching a connector having a plurality of pads for interfacing with a plurality of pads on a device under test, the adapter comprising:

a carrier having a plurality of voids formed therein in a pattern matching a pattern of pads on the connector, said voids traversing from a first surface to a second surface of the carrier; and at least one electrical component embedded in at least one void, said at least one electrical component forming a first adapter pad on the first surface of the carrier for contacting a pad on the connector and a second adapter pad on the second surface of the carrier for contacting a pad on the device under test, whereby the electrical component electrically serially connects the corresponding pad on the device under test to the corresponding pad on the connector when the adapter is interposed between the connector and the device under test.

2. The adapter, as set forth in claim 1, wherein the at least one electrical component comprises a conductive bar.

3. The adapter, as set forth in claim 1, wherein the at least one electrical component comprises a resistor.

4. The adapter, as set forth in claim 1, wherein the at least one electrical component comprises a capacitor.

5. The adapter, as set forth in claim 1, wherein the at least one electrical component comprises an inductor.

6. The adapter, as set forth in claim 1, wherein the at least one electrical component comprises an RC network.

7. The adapter, as set forth in claim 1, wherein the at least one electrical component comprises an RCR network.

8. The adapter, as set forth in claim 1, wherein the plurality of voids are a plurality of slots formed on at lease one edge of the carrier.

9. The adapter, as set forth in claim 1, wherein the carrier has a thickness that is less than the height of the electrical component.

10. The adapter, as set forth in claim 1, wherein the at least one electrical component comprises at least one 0201 sized discrete component.

11. A probe comprising:

a connector having a plurality of pads for interfacing with a plurality of pads on a device under test;

a carrier, interfacing with the connector, having voids therein in a pattern matching a pattern of pads on the connector, said voids traversing from a first surface to a second surface of the carrier; and at least one electrical component embedded in at least one void, said at least one electrical component forming a first adapter pad on the first surface of the carrier that electrically contacts a matching pad on the connector and a second adapter pad on the second surface of the carrier for contacting a pad on the device under test such that each at least one electrical component is inserted in series between corresponding pads on the connector and the device under test when the probe is connected to the device under test.

12. An adapter for attaching a connector to a device under test, the adapter comprising:

a carrier having a length and a width corresponding to a length and width of the connector, the carrier having a plurality of voids formed near the edges of the carrier parallel to a longitudinal axis of the carrier, said voids corresponding to pads on the connector; and a plurality of electrical components secured in a majority of the voids whereby the electrical components form pads on opposite surfaces of the carrier for contacting pads on the connector and electrically connecting the connector to the device under test while serially interposing the electrical components between respective pads on the connector and pads on the device under test.

13. A method of fabricating an adapter for attaching a connector having a plurality of pads for interfacing with a plurality of pads on a device under test, the method comprising:

forming a carrier having a length and a width corresponding to a length and width of the connector;

forming a plurality of voids near the edges of the carrier parallel to a longitudinal axis of the carrier, said voids corresponding to pads on the connector; and securing a plurality of electrical components in a majority of the voids whereby the electrical components form pads on opposite surfaces of the carrier to serially interpose each electrical component between corresponding pads on the connector and the device under test.

* * * * *